US007458195B2

(12) United States Patent
Bezek et al.

(10) Patent No.: US 7,458,195 B2
(45) Date of Patent: Dec. 2, 2008

(54) METHOD FOR MAKING A MULTI-COMPARTMENT MICROWAVABLE PACKAGE HAVING A PERMEABLE WALL BETWEEN COMPARTMENTS

(75) Inventors: Edward Anthony Bezek, Frisco, TX (US); Anthony Robert Knoerzer, Parker, TX (US); Garrett William Kohl, Allen, TX (US); Brad Dewayne Rodgers, Arlington, TX (US); Steven Kenneth Tucker, Hurst, TX (US)

(73) Assignee: Frito-Lay North America, Inc., Plano, TX (US)

( * ) Notice: Subject to any disclaimer, the term of this patent is extended or adjusted under 35 U.S.C. 154(b) by 0 days.

(21) Appl. No.: 11/622,121

(22) Filed: Jan. 11, 2007

(65) Prior Publication Data

US 2007/0127853 A1 Jun. 7, 2007

Related U.S. Application Data

(63) Continuation-in-part of application No. 11/036,802, filed on Jan. 14, 2005, now Pat. No. 7,178,313.

(51) Int. Cl.
*B65B 5/10* (2006.01)
*B65B 9/20* (2006.01)

(52) U.S. Cl. ..... 53/445; 53/451; 53/474; 53/155; 53/551; 53/238; 493/254

(58) Field of Classification Search ..... 53/396, 53/440, 445, 450, 451, 474, 127, 155, 158, 53/550, 551, 238, 246; 206/216; 219/731; 383/38, 40; 426/107, 112, 113, 124, 234, 426/410; 493/254

See application file for complete search history.

(56) References Cited

U.S. PATENT DOCUMENTS

| | | | | | |
|---|---|---|---|---|---|
| 2,741,559 | A | * | 4/1956 | Banowitz | 426/120 |
| 3,323,640 | A | * | 6/1967 | Kugler | 426/112 |
| 3,939,971 | A | * | 2/1976 | Tulis | 383/38 |
| 4,256,256 | A | * | 3/1981 | Meyers | 383/40 |
| 4,596,713 | A | * | 6/1986 | Burdette | 426/107 |
| 4,776,455 | A | * | 10/1988 | Anderson et al. | 383/38 |
| 4,806,371 | A | * | 2/1989 | Mendenhall | 426/113 |
| 4,851,246 | A | * | 7/1989 | Maxwell et al. | 426/107 |
| 4,866,786 | A | * | 9/1989 | Nagler | 426/107 |
| 4,987,280 | A | * | 1/1991 | Kanafani et al. | 219/731 |
| 5,373,966 | A | * | 12/1994 | O'Reilly et al. | 53/451 |

(Continued)

FOREIGN PATENT DOCUMENTS

JP 62-262955 A * 11/1987

(Continued)

*Primary Examiner*—Stephen F Gerrity
(74) *Attorney, Agent, or Firm*—Carstens & Cahoon; Colin P. Cahoon; Chad E. Walter

(57) ABSTRACT

A method for making a multi-compartment microwavable package having one or more open or closed compartments within the package, and method and apparatus for manufacturing the same, constructed by modification to existing vertical form, fill and seal packaging machines. The invention involves producing a multi-compartment bag having an internal permeable wall between compartments from a single sheet of flexible packaging film. A food product can be placed into the first compartment and steam pack can be placed into the second compartment.

11 Claims, 11 Drawing Sheets

U.S. PATENT DOCUMENTS

| | | | | | |
|---|---|---|---|---|---|
| 5,376,392 | A | * | 12/1994 | Ikegami et al. | 383/113 |
| 5,407,278 | A | * | 4/1995 | Beer | 383/38 |
| 6,119,855 | A | * | 9/2000 | Yeager et al. | 206/213.1 |
| 6,364,864 | B1 | * | 4/2002 | Mohiuddin et al. | 206/219 |
| 6,455,084 | B2 | * | 9/2002 | Johns | 426/107 |
| 6,641,306 | B1 | * | 11/2003 | Knoerzer et al. | 383/38 |
| 7,178,313 | B2 | * | 2/2007 | Bezek et al. | 53/445 |
| 2004/0169037 | A1 | * | 9/2004 | Roussel et al. | 219/731 |
| 2007/0029314 | A1 | * | 2/2007 | Rodgers et al. | 219/730 |

FOREIGN PATENT DOCUMENTS

| | | | | |
|---|---|---|---|---|
| JP | 63-131926 | A | * | 6/1988 |
| JP | 64-45208 | A | * | 2/1989 |
| JP | 9-66943 | | * | 9/1997 |
| JP | 2001-292708 | | * | 10/2001 |

* cited by examiner 918
418
920
926
910
922
420
418
426
114
114
926
122
126
120
120
912
126
106
104
104
104
106
126
112
912
910

METHOD FOR MAKING A MULTI-COMPARTMENT MICROWAVABLE PACKAGE HAVING A PERMEABLE WALL BETWEEN COMPARTMENTS

CROSS REFERENCE TO RELATED APPLICATION

This application is a continuation-in-part of U.S. application Ser. No. 11/036,802 entitled "Method for Making a Package Having at Least Two Items" and filed on Jan. 14, 2005, now U.S. Pat. No. 7,178,313.

BACKGROUND OF THE INVENTION

1. Technical Field

The present invention relates to a method for making a microwavable package having a permeable compartment constructed using a modified vertical form, fill, and seal packaging machine, and the apparatus and method for making same, that provides for a single piece construction of the package. The invention allows for use of existing converter and packaging technology to produce a microwavable package having one or more permeable compartments with minimal increased cost and minimal modification.

2. Description of Related Art

Vertical form, fill, and seal packaging machines are commonly used in the snack food industry for forming, filling, and sealing bags of chips and other like products. One such packaging machine is seen diagrammatically in FIG. 1. This drawing is simplified and does not show the cabinet and support structures that typically surround a machine, but it demonstrates the working of the machine well. Packaging film 110 is taken from a roll 112 of film and passed through tensioners 114 that keep it taut. The film then passes over a former 116, which directs the film into a vertical tube around a product delivery cylinder 118. As the tube is pulled downward by drive belts 120 the vertical tube of film is sealed along its length by a vertical sealer 122, forming a back seal 124. The machine then applies a pair of heat sealing jaws 126 against the tube to form a transverse seal 128. This transverse seal 128 acts as the top seal on the bag 130 below the sealing jaws 126 and the bottom end seal on the bag 132 being filled and formed above the jaws 126. After the transverse seal has been formed, a cut is made across the sealed area to separate the finished bag 130 below the seal 128 from the partially completed bag 132 above the seal. The tube is then pushed downward to draw out another package length. Before the sealing jaws form each transverse seal, the product to be packaged is sent through the product delivery cylinder 118 and is held within the tube above the transverse seal 128. The material that is fed into the form, fill and seal machine is typically a packaging film such as polypropylene, polyester, paper, polyolefin extrusions, adhesive laminates, and other such materials, or from layered combinations of the above. For many food products, where flavor retention is important, a metalized layer will form the inner most layer.

One modification to a vertical form, fill, and seal packaging machine is disclosed in U.S. Pat. No. 6,722,106 ("the '106 Patent"), which is assigned to the same assignee as the present invention. The '106 Patent discloses a method for making a free standing package called a vertical stand up pouch. The modification uses two forming plates 104 and a tension bar 102 to hold the packaging film tube in tension from inside the tube. Tension is applied on the outside of the film and in the opposite direction of the tension provided by the forming plates 104 by a fixed or stationary tucker mechanism 106 positioned between the forming plates 104. When the tucker bar 106 is properly positioned, it provides a crease or fold in the tube of the packaging film between the two forming plates 104. This creates a gusset 135 that permits the package to stand upright on the gusset 135. The crease is formed prior to formation of the transverse seal by the seal jaws 126. Consequently, once the transverse seal is formed, the crease becomes an integral feature of one side of the package.

The vertical form and fill machine thereafter operates basically as previously described in the prior art, with the sealing jaws 126 forming a lower transverse seal (and upper transverse seal for the bag below), and product being introduced through the forming tube 101 into the sealed tube of packaging film which now has a crease on one side. The film is then pulled downward by moving belts 120 and the upper transverse seal is formed, thereby completing the package. An example of the vertical stand up package formed is shown in FIGS. 2*a* and 2*b*. The outside layer of packaging film show the graphics 179 oriented 90 degrees clockwise from graphics orientation normally present on a pillow pouch formed by a standard prior art vertical form, fill and seal machine. As shown in FIG. 2*b* the transverse seals 128 of the vertical stand up package are oriented vertically once the bag stands up on one end as shown in FIG. 2*b*. FIG. 2*a* shows the crease 176 that was formed by the tucker bar 106 and forming plates 104 shown in FIG. 1 to create a gusset 135 that permits the package to stand upright. Various modifications of the vertical stand up pouch, methods for making the pouch, and apparatuses for making the pouch are disclosed in U.S. Pat. Nos. 6,729,109 and 6,679,034.

Another self standing flexible pouch is disclosed in U.S. Pat. No. 6,679,630 also assigned to the same assignee as the present invention. FIG. 3*a* is cross-sectional view of the self standing flexible package disclosed in the '630 Patent. Referring to FIG. 3*a*, the '630 patent teaches a package 70 having a flap 78 formed by creating a bend 84 in the film to form an inner portion of flap 78. An opening 90 is formed between the inner and outer portions of the flap 78. FIG. 3*b* shows a completed package 70 in a standing or display position. Referring to FIGS. 3*a* and 3*b*, as package 70 is shown standing, flap 78 extends outward and away from back forming pocket 80. To enclose and retain any product within the package a back seal 124 seals the film tube and transverse end seals 128 seal the terminal ends of package 70. The transverse seals 128 also serve to retain the flap 78 to the terminal ends of package 70. Unfortunately, the '630 Patent requires the flap 78 to be manually drawn away from the back for the package 70 to stand erect with the use of a flap 78. Thus, the package requires manual manipulation to stand up. In addition, because packages are typically opened at the transverse seals, product can spill out of the package after the package is opened, when the package is in the stand up position. Thus, there is a need to provide a package having a compartment or pocket that permits the compartment to hold different contents than are held in the main portion of a package when the package stands erect. Consequently, a need exists for a vertical stand-up package having one or more open compartments that are accessible while the package is standing erect that minimizes the use of film. The prior art discloses other containers often associated with TV dinners having multi-compartment food containers where the compartments are adjacent and integrated into the container. Unfortunately, many of these food containers are made from more expensive thermoforming techniques. Consequently, a need exists for a multi-compartment food container that can be made from an economical modification of a vertical form, fill, and seal machine.

Further, a need also exists for an economical method for making a multi-compartment container having a porous wall between the compartments. Such container can be useful for microwave oven applications.

SUMMARY OF THE INVENTION

The proposed invention involves producing a microwavable package having one or more permeable compartments constructed from a single sheet of material using a vertical form, fill, and seal machine modified with a spiral former, a first and second filling structure, and an optional gusseting mechanism. The former receives flexible packaging film and forms a tube having an overlap end and an inner end comprising a permeable portion. The overlap is sealed to the tube thereby causing the inner end to form an internal permeable compartment wall. The optional gusseting mechanism creates a vertical tuck along the length of the bag while it is being formed permitting the package to stand up once the transverse end seals are made. In one embodiment, two gussets are made to permit the package to expand upon microwave heating.

The method disclosed and the package formed as a consequence is a substantial improvement over prior art packages having a compartment. The method works on existing vertical form, fill, and seal machines requiring little modification. There are no jaw carriage modifications involved. The bag makers can be easily converted back to a pillow pouch configuration with a relatively few simple changes. A microwave safe film sheet having a permeable portion can easily be used in place of a traditional film sheet. The above as well as additional features and advantages of the present invention will become apparent in the following written detailed description.

BRIEF DESCRIPTION OF THE DRAWINGS

The novel features believed characteristic of the invention are set forth in the appended claims. The invention itself however, as well as a preferred mode of use, further objectives and advantages thereof will be best understood by reference to the following detailed description of illustrative embodiments when read in conjunction with the accompanying drawings, wherein:

DETAILED DESCRIPTION

Figure 4:
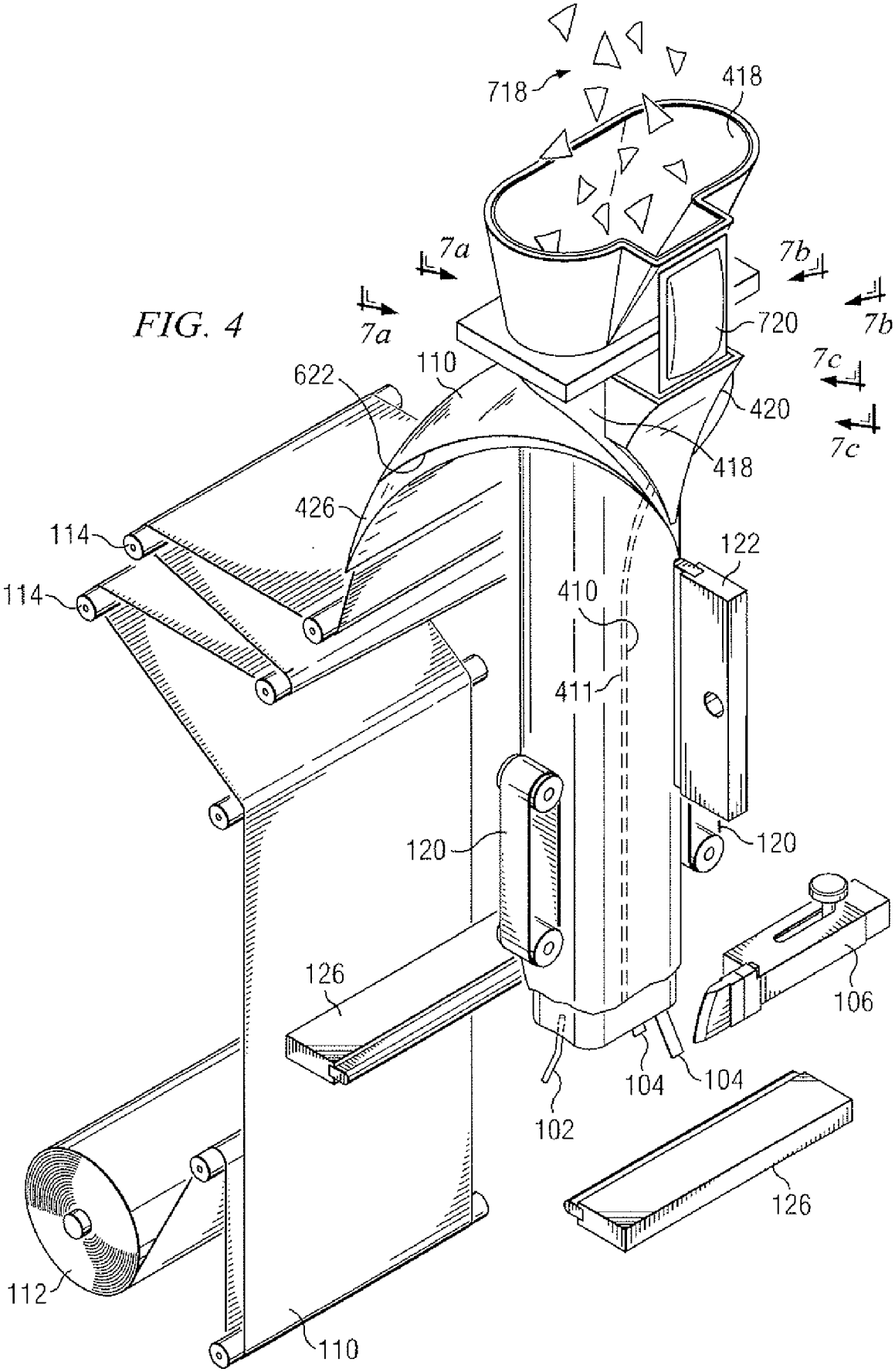
FIG. 4 is a perspective view of one embodiment of the present invention depicting a modified form, fill, and seal machine.

FIG. 4 is a perspective view of one embodiment of the present invention depicting a modified form, fill, and seal machine. A spiral former 426 receives the packaging film 110 and directs the compartment terminal end 410 around a fill tube or first filling structure 418 to receive a first item 718. The former 426 simultaneously directs the tube terminal end 622 (film overlap end) to overlap the compartment terminal end 410 (film inner end). Thus, in the embodiment shown, the spiral former 426 creates a tube having an enclosed channel in communication with a first filling structure 418 and an open channel in communication with a second filling structure 420. The second filling structure 420 is adjacent the first filling structure 418 and situated so as to permit a second item 720 to be placed in the open channel. The open channel becomes the compartment when the package is sealed.

Figure 5A:
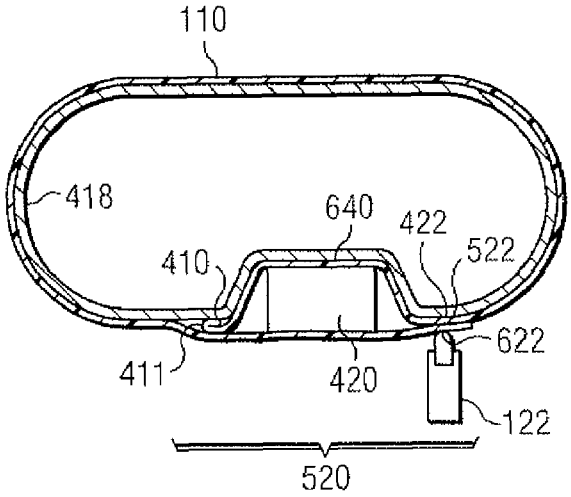
FIG. 5*a* is a simplified top view of the dual delivery tube assembly of one embodiment of the present invention.

FIG. 5*a* is a simplified top view depicting the former and dual delivery tube assembly of one embodiment of the present invention. In the embodiment shown, an indention in the first filling structure 418 creates a channel for placement of the second filling structure 420. This indention, however, is not required and is shown to be illustrative of one embodiment. The film tube comprises an inner compartment wall 640 bounded by a compartment terminal end 410 and a compartment seal end 422.

Referring to FIGS. 4 and 5*a*, as the film tube is pulled downward by drive belts 120, the vertical tube terminal end 622 of film is sealed to the compartment seal end 422 by a vertical sealer 122. The vertical sealer 122 can use heat seal or cold seal technology. The tube then passes over two forming plates 104 and a tension bar 102. A tucker bar 106, positioned between the forming plates 104, provides a crease or fold in the tube of packaging film between the two forming plates 104. The sealing jaws 126 then form a first end seal.

Figure 5B:
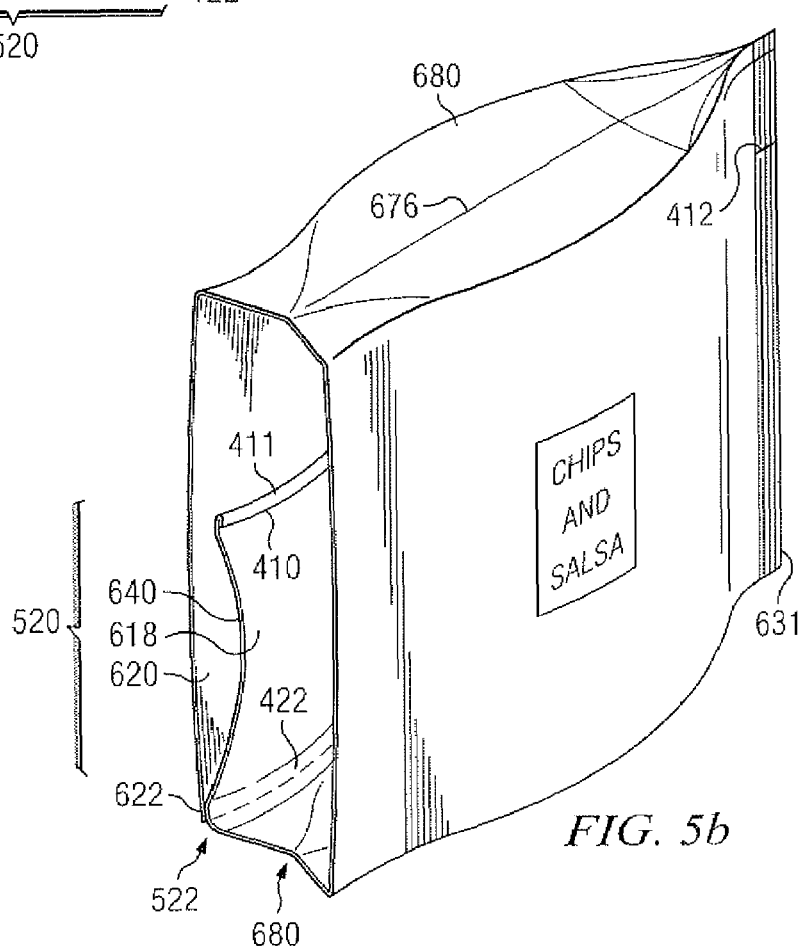
FIG. 5*b* is a cut away perspective view of the package in accordance with one embodiment of the present invention.

FIG. 5*b* is a cut away perspective view of the package in accordance with one embodiment of the present invention. Referring to FIGS. 5*a* and 5*b*, the lap seal 522, created by the vertical sealer 122, has sealed the seal end 422 of the compartment wall 640 and the tube terminal end 622. The compartment terminal end 410 of the compartment wall 640 is secured within the package by the first end seal 631 at the location generally depicted by numeral 412. A compartment 620 is thereby formed that is bounded by an overlapped segment of film 520, or overlap wall 520 of the tube, the lap seal 522 and the compartment wall 640. The main portion 618 is bounded by the compartment wall 640 and the gusset 680.

Figure 5D:
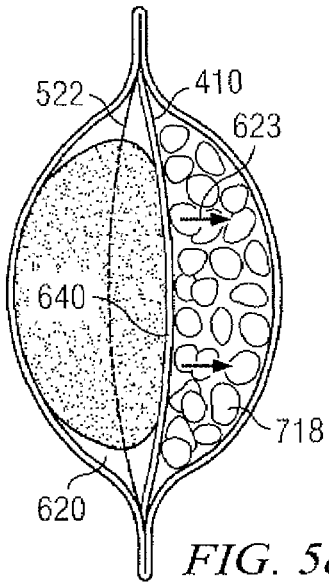
FIG. 5*d* depicts a cut away top view of one embodiment of the present invention having salsa poured into the compartment.
Figure 5C:
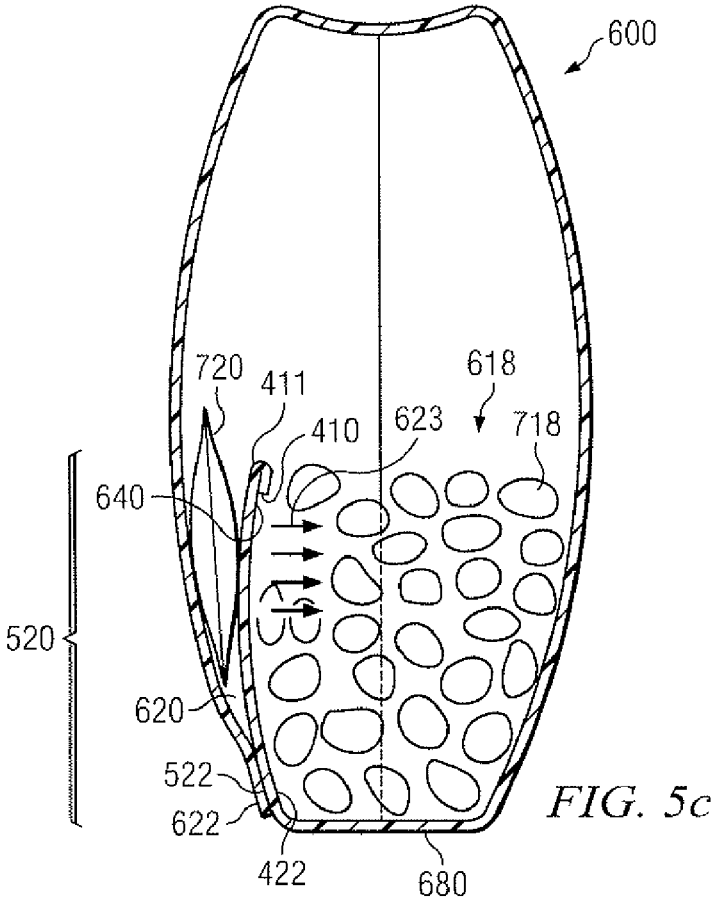
FIG. 5*c* is a cut-away side view of the package in accordance with one embodiment of the present invention.

FIG. 5*c* is a cut-away side view of the package in accordance with one embodiment of the present invention. In the embodiment shown, the package 600 comprises two compartments 618 620 open to one another. A first item 718 rests in the main portion 618 of the package 600 while a second item 720 is disposed within the compartment portion 620 of the package 600. The first and second items are separated by a compartment wall 640. As shown by FIG. 5*c*, the package is formed by a single sheet of film formed into a tube having an overlap wall 520. The terminal end 622 of the overlap wall 520 is sealed with a lap seal 522 to the compartment seal end 422 of the compartment wall 640. It should be noted that the height of the compartment wall 640 can be adjusted as desired. Additionally, as will be discussed in greater detail below, the top of the compartment wall 640 can be sealed to the overlap wall 520 to form a closed compartment. Such embodiment could prove advantageous, for example, to permit placement of a liquid in either compartment or to prevent the compartments from sharing headspace.

Referring to FIGS. 4, 5*a*, and 5*b*, upon completion of the first end seal 631, a first item 718 can be dropped through a first filling structure 418 in communication with the main portion 618 of the tube. Similarly, a second item 720 can be dropped through a second filling structure 420 in communication with the compartment portion 620 of the tube. The items can be dropped simultaneously. Once the first item 718 and second item 720 have been placed in the package, a second end seal can be provided by the sealing jaws 126.

Figure 6A:
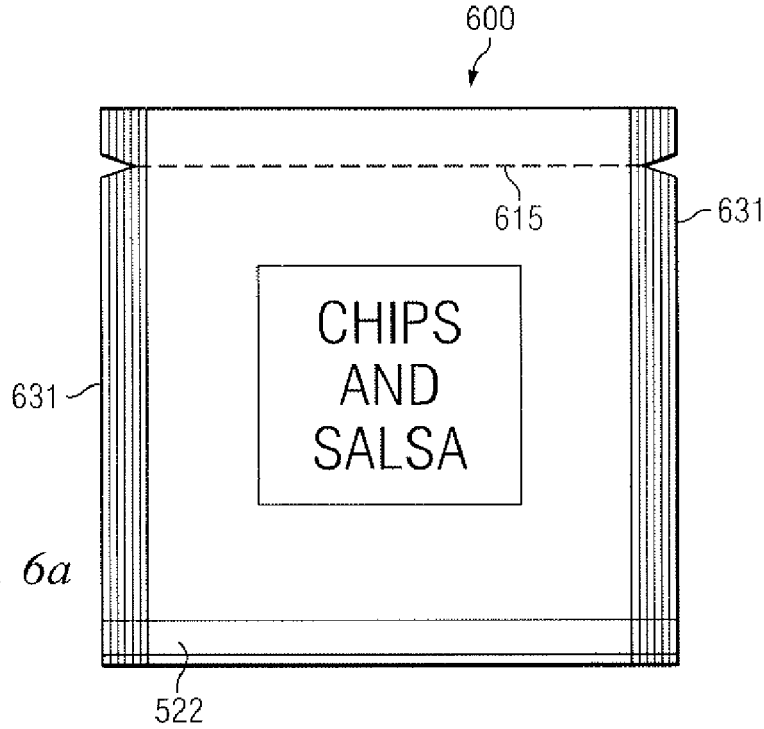
FIG. 6*a* is a front view of one embodiment of the vertical stand-up package having a compartment.
Figure 6B:
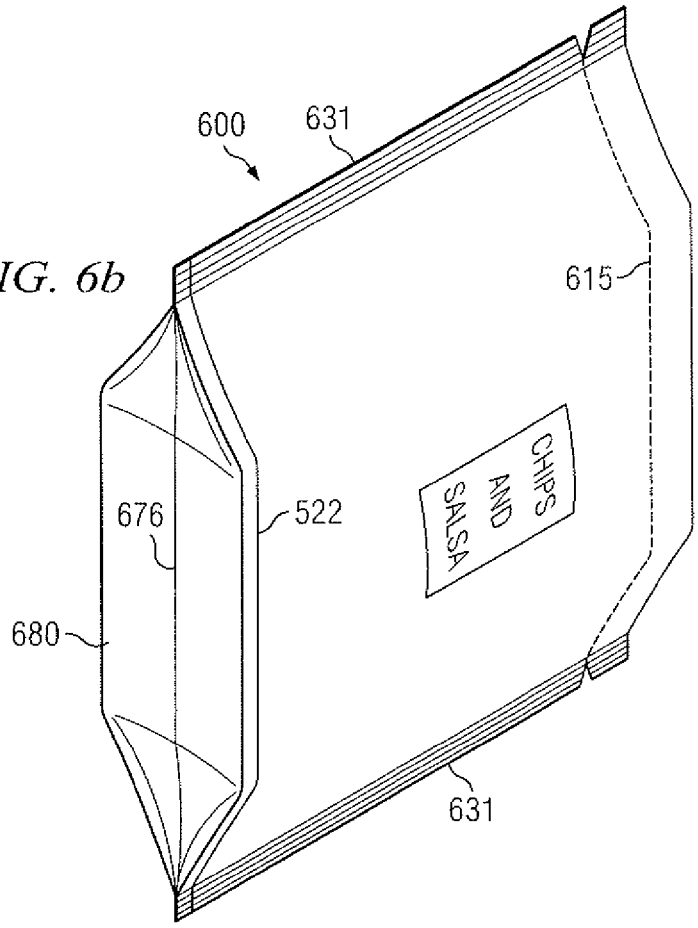
FIG. 6*b* is a perspective bottom view of the package depicted in FIG. 6*a*.

FIG. 6*a* is a front view of one embodiment of the vertical stand up package having a compartment. FIG. 6*b* is a bottom perspective view of the package depicted in FIG. 6*a*. The flexible vertical stand up package 600 rests on the gusset 680 having a crease 676 and, unlike a standard pillow pouch package, the end seals 631 are oriented in a vertical direction. A score line 615 can facilitate opening the package by removing the top. In a preferred embodiment, the lap seal 522 is located adjacent the gusset 680 to provide additional stability for the stand up package 600.

Figure 1:
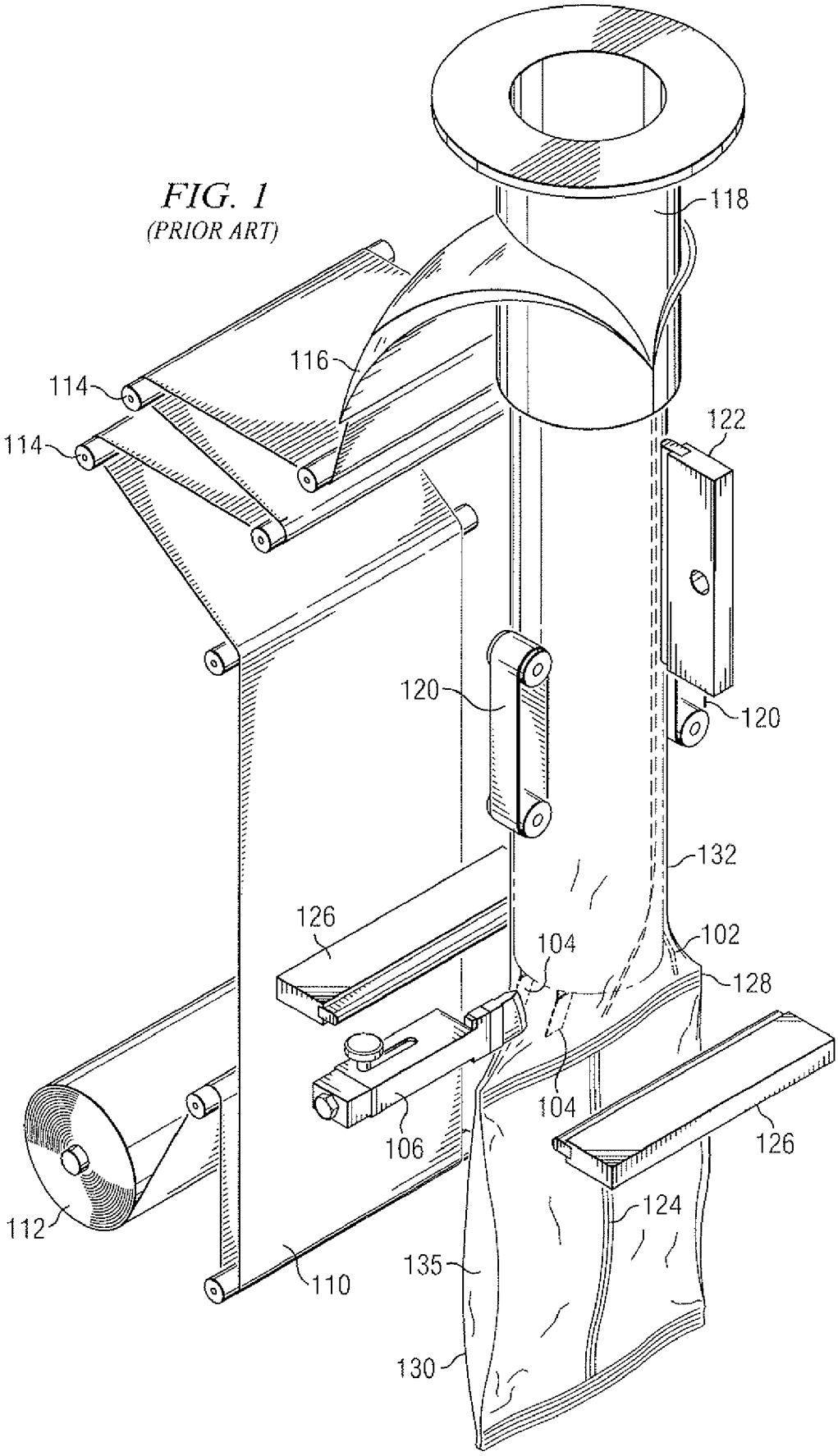
FIG. 1 (PRIOR ART)
FIG. 1 is a perspective view of a prior art form, fill, and seal machine.
Figure 2A:
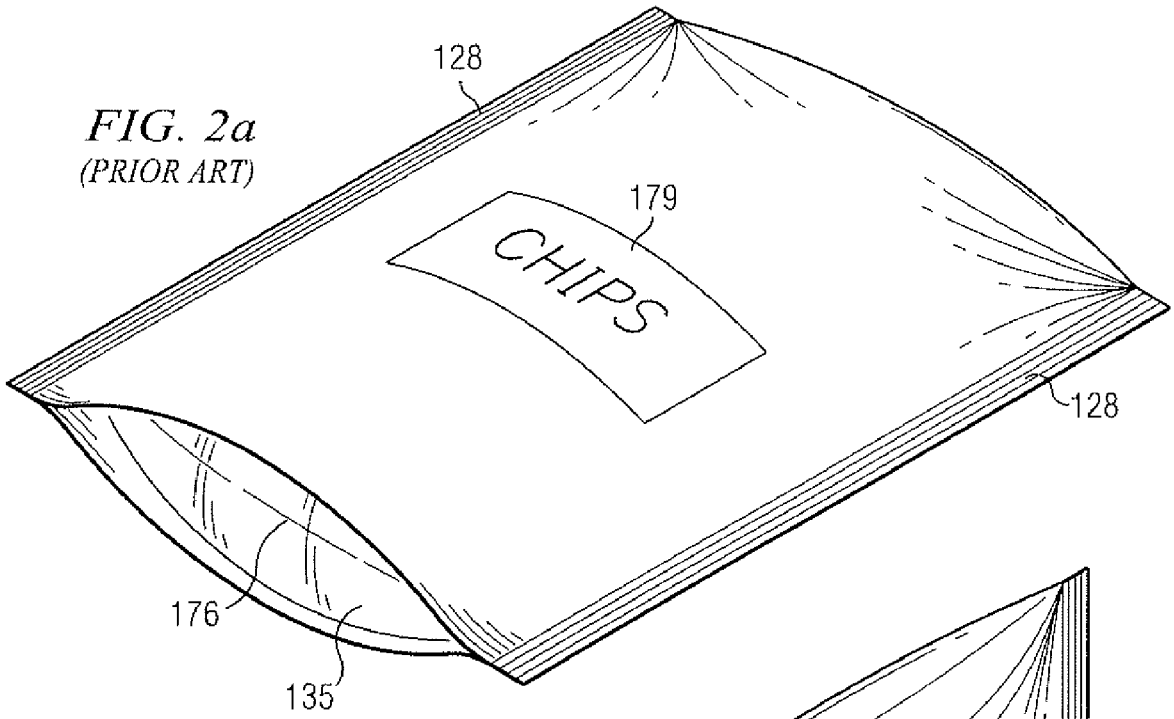
FIG. 2a (PRIOR ART)
FIGS. 2*a* and 2*b* are perspective views of prior art vertical stand-up packages.
Figure 2B:
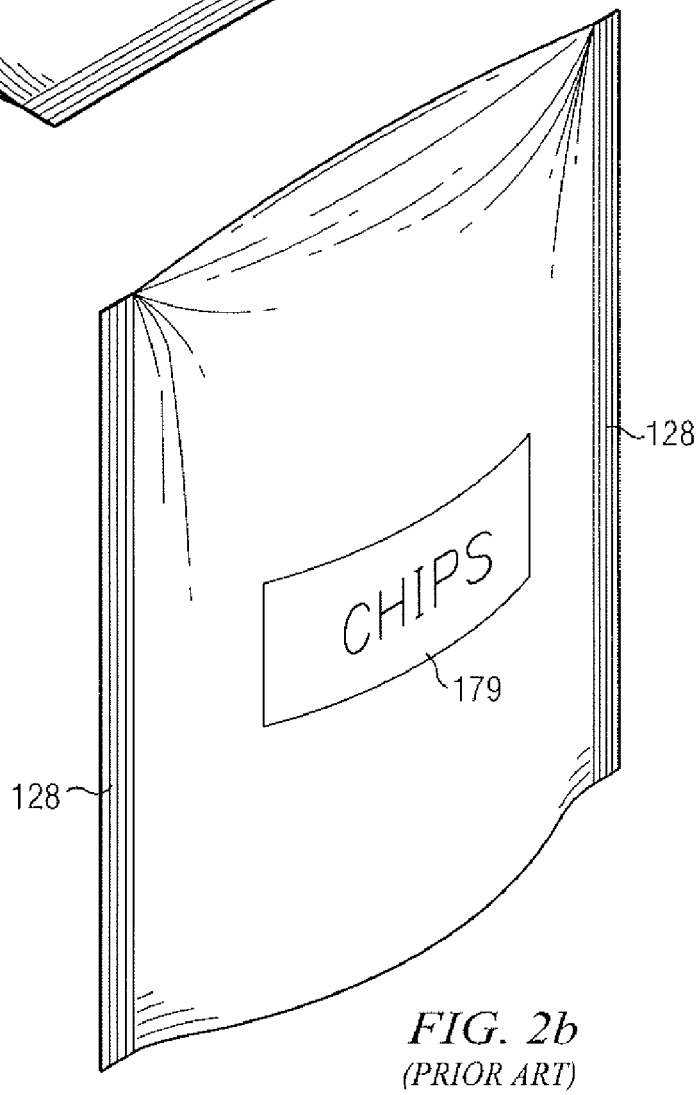
FIG. 2b (PRIOR ART)
Figure 3A:
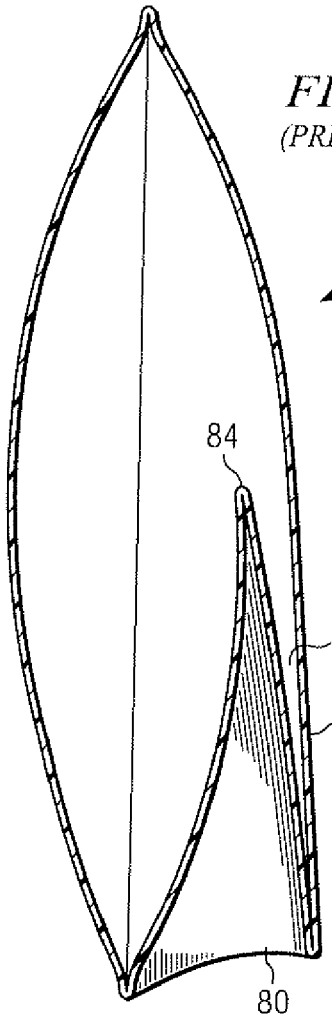
FIG. 3a (PRIOR ART)
FIG. 3*a* is a cross-sectional view of a prior art package capable of self support having a pouch.
Figure 3B:
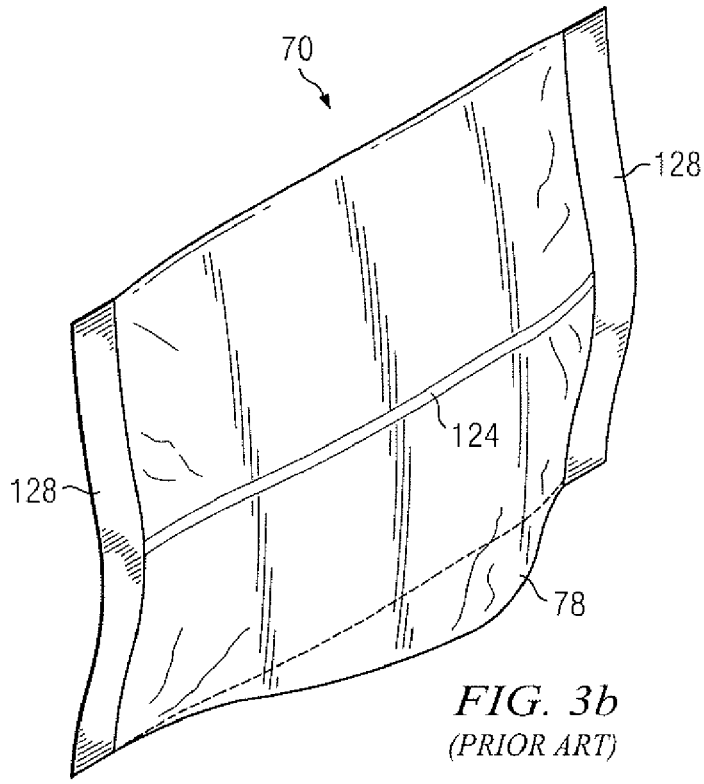
FIG. 3b (PRIOR ART)
FIG. 3*b* is a perspective view of a prior art package.

One advantage of the package formed by the present invention is that complementary items can be stored in the package. For example, in one embodiment the first item can comprise tortilla chips and the second item can comprise pre-packaged salsa. The salsa can be pre-packaged in a traditional pillow package by a prior art vertical form, fill, and seal machine similar to that depicted in FIG. 1. The vertical stand up package can then be opened, the pre-packaged salsa can be retrieved from the open compartment, opened, and poured into the pouch from which it was retrieved. In an alternative embodiment, salsa or other liquid can be directly placed into a closed compartment.

FIG. 5*d* depicts a cut away top view of one embodiment of the present invention having salsa poured into the compartment 620. Salsa, when poured into the compartment 620, applies pressure at the compartment wall 640 and can press the compartment wall 640 in the direction of the arrows 623 shown in FIG. 5*c* and FIG. 5*d* to form a dipping well. Surprisingly, when the compartment terminal end 410 is folded over a portion of the compartment wall 640, the integrity of the compartment 620 is enhanced and salsa, or other product, is less likely to spill from the compartment 620 over the compartment wall 640 into the main portion 618 of the package. Thus, the present invention permits a consumer to purchase a package having chips and salsa, and to then use the package to consume the chips and salsa directly from the stand up package without the chips spilling out of the package or using (and potentially dirtying) a salsa dish. Such package can be ideal for picnics or anytime a ready-to-eat product is desired.

Figure 7A:
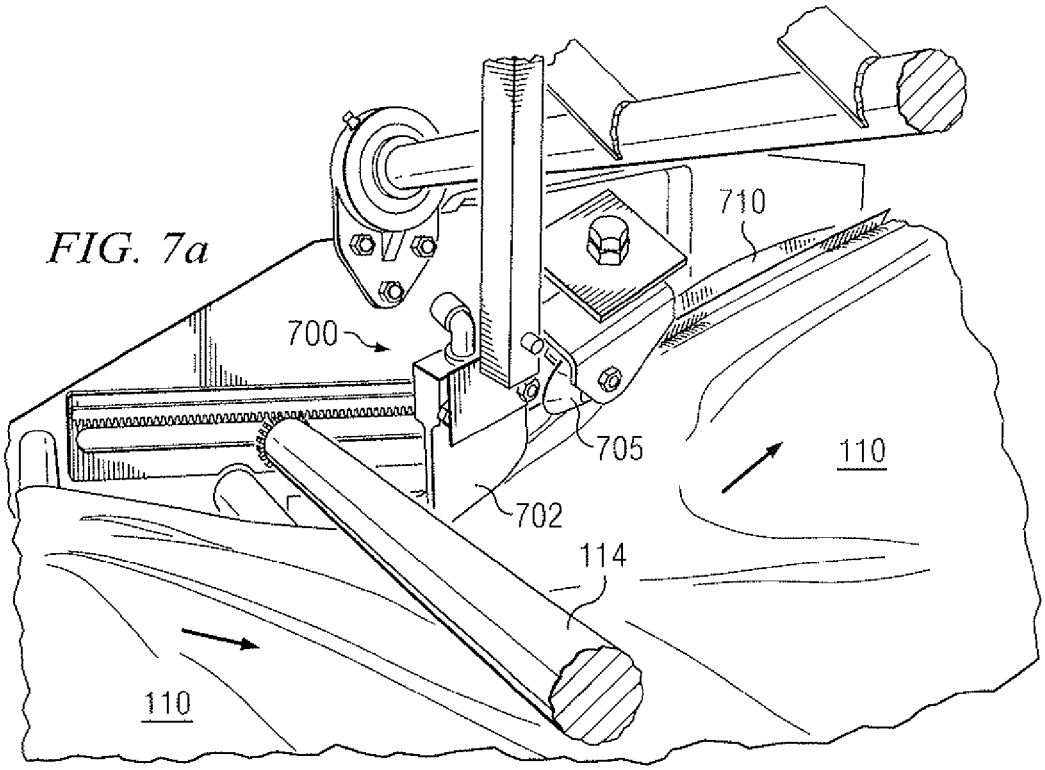
FIG. 7*a* is a perspective view of a folding device adjacent the vertical form fill and seal machine along line 7A-7A of FIG. 4 in accordance with one embodiment of the present invention.
Figure 7B:
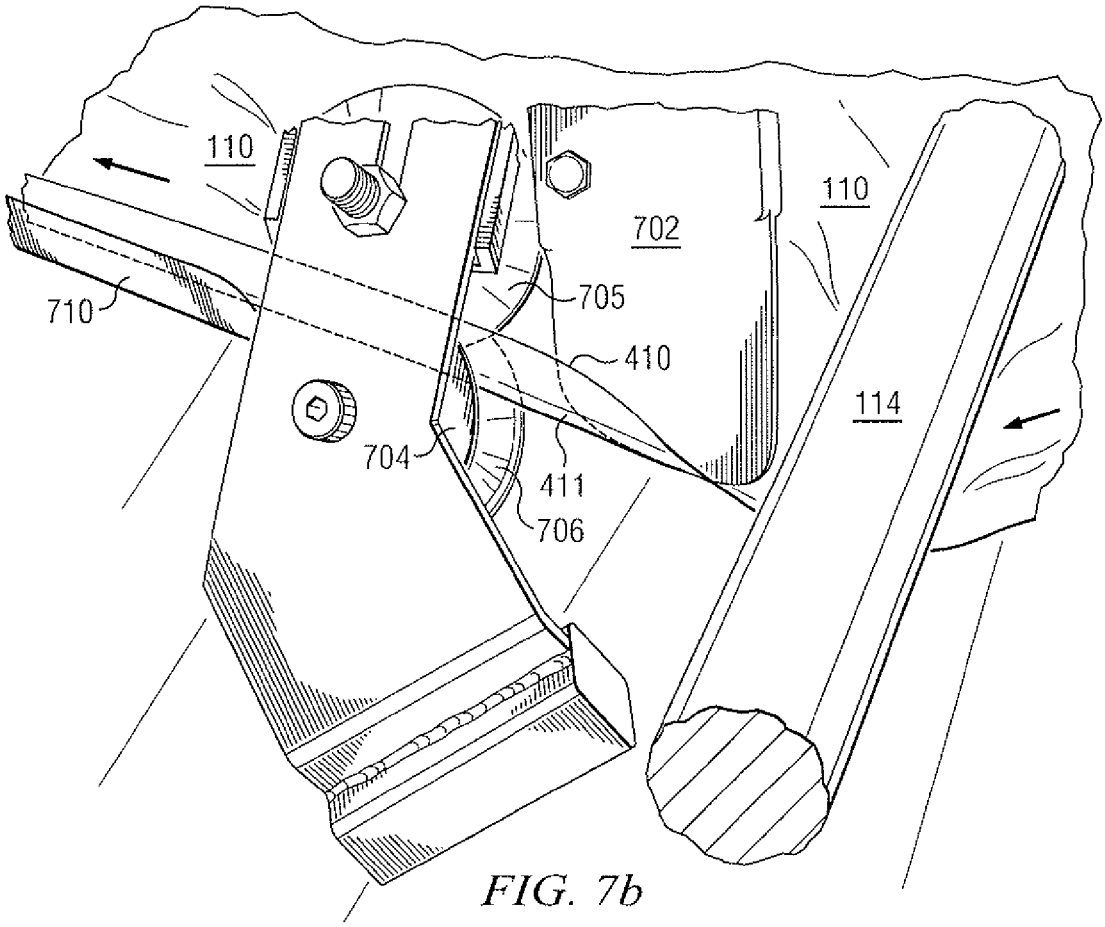
FIG. 7*b* is a perspective view of the folding device depicted in FIG. 7*a* along line 7B-7B of FIG. 4
Figure 7C:
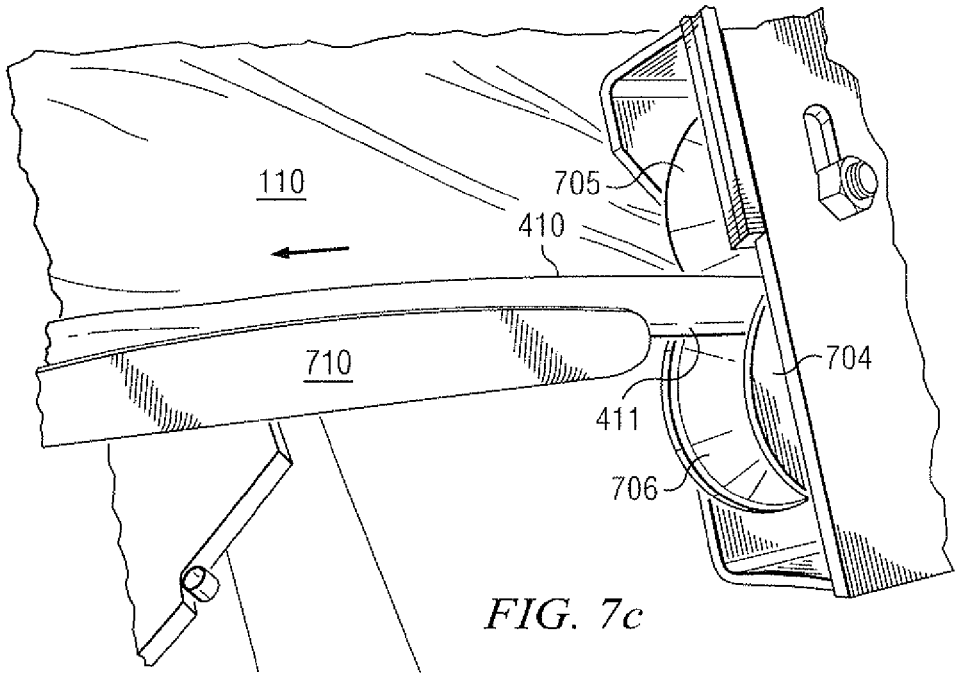
FIG. 7*c* is a perspective view of a folding device depicted in FIG. 7*a* along line 7C-7C of FIG. 4.

FIG. 7*a* is a perspective view of a folding device adjacent the vertical form fill and seal machine along line 7A-7A of FIG. 4 in accordance with one embodiment of the present invention. FIG. 7*b* is a perspective view of the folding device depicted in FIG. 7*a* along line 7B-7B of FIG. 4. FIG. 7*c* is a perspective view of a folding device depicted in FIG. 7*a* along line 7C-7C of FIG. 4. Referring to FIGS. 4, 5*c*, 7*a*-7*c*, the rolled edge can be formed with a folding device 700 near the former 426 to permit a portion of the film which eventually becomes the compartment wall 640 terminal end 410 to fold over a portion of itself so as to provide a j-shaped rolled edge or fold having a trough 411 and a terminal end 410. In the embodiment shown, the folding device 700 comprises a tucker bar 702 and a pair of rollers 704 705. The angle that the tucker bar 702 engages the film 110 can be adjusted to obtain the desired fold. In the embodiment shown, the v-shaped bottom roller 704 comprises a channel 706. The top disc-shaped roller 705 is disposed within the channel 706. The tucker bar 702, positioned between the tensioner 114 and the pair of rollers 704 705 provides a j-shaped fold having a terminal end 410 and a trough end 411.

While the folding device 700 as shown comprises a tucker bar 702 and a pair of rollers 704 705, in one embodiment, the folding device 700 comprises the tucker bar 702. In one embodiment, the trough end 411 of the fold passes through the channel 706 of the bottom v-shaped roller 704. The outer edge of the disc-shaped top roller 705 is bounded on two sides by the packaging film 110 as the packaging film 110 passes through the channel 706 of the bottom v-shaped roller 704. In one embodiment, the former 426 comprises a gutter 710 mounted adjacent the edge of the former. The gutter 710 can be substantially perpendicular to the former edge.

Figure 8A:
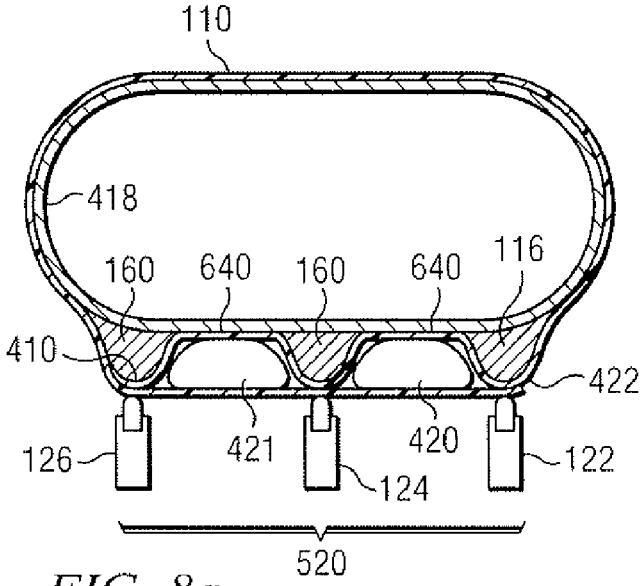
FIG. 8*a* is a simplified top view of the multi-delivery tube assembly in accordance with one embodiment of the present invention.

FIG. 8*a* is a simplified top view of the multi-delivery tube assembly in accordance with one embodiment of the present invention. In the embodiment shown, extensions 160 are attached to the first filling structure 418. As shown in FIG. 8*a*, the multi-delivery tube assembly comprises a first filling structure 418, a second filling structure 420 and a third filling structure 421. In addition, the multi-delivery tube assembly depicted in FIG. 8*a* comprises a first vertical sealer 122, a second vertical sealer 124 and a third vertical sealer 126 for sealing portions of the overlap segment 520 of film to a portion of the inner compartment wall 640.

Figure 8B:
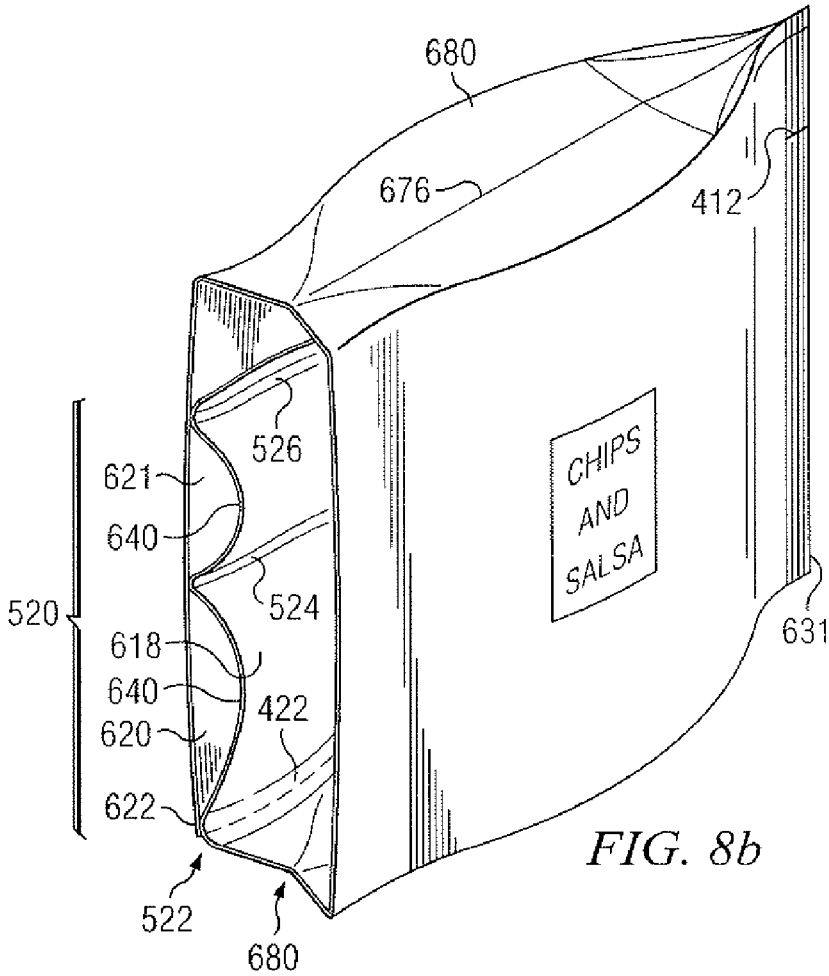
FIG. 8*b* is a cut-away perspective view of the package made from the assembly depicted in FIG. 8*a*.

FIG. 8*b* is a cut-away perspective view of the package made from the assembly depicted in FIG. 8*a*. As shown in the Figure, the overlap segment 520 comprises a first longitudinal seal 522, a second longitudinal seal 524, and a third longitudinal seal 526. In the embodiment shown, the package comprises three compartments 618 620 621 closed from one another. In one embodiment, one or more of the longitudinal seals 522 524 526 comprises a cold seal. Cold seal technology is well known in the art and is widely used to close food packages having heat-sensitive foods such as chocolate bars where heat sealing of the package is not desirable. Cold seal adhesives are typically coated or printed onto a flexible packaging film to permit sealing of the package with pressure.

It should be noted that there are several potential embodiments of the present invention. For example, referring to FIG. 8*b*, in one embodiment if the third longitudinal seal 526 is omitted, the package can have a first compartment 618, a sealed second compartment 620 and a third open compartment 621. Thus, a package having two compartments 618 621 open to one another and a closed compartment 620 can be produced.

Examples of package applications, such as complementary products that can be packaged together in the main portion and compartment include crackers and cheese, cake mix and pre-packaged icing, or ready to eat cereal, milk, and/or a utensil such as a spoon. A pre-packaged seasoning can be placed in the compartment portion and a dehydrated food, such as noodles, can be placed in the main portion. The seasoning can be removed, water added to the main portion 618, the entire package can then be heated in a microwave, the seasoning can be added, and the consumer can consume the food product directly from the main portion 618 of the package.

Promotional items can be also placed in the compartment with product placed in the main portion of the package. Thus, a consumer desiring to immediately access the promotional item can easily do so without immersing one's hand and fingers in product. For example, a promotional coupon can be placed into compartment portion of the package while potato chips are placed into the main portion. A consumer may only want a portion of potato chips, but may want to also access the promotional coupon. The promotional coupon, in prior art packages having no compartment often falls to the bottom of the package. Thus, a consumer may be forced, in a prior art package, to dig with his or her hand through the potato chips in order to access the promotional coupon. The present invention, on the other hand, permits a consumer to simply reach directly into the compartment to retrieve the promotional coupon without contacting product. The food package need not be limited to shelf-stable food products. For example, the package of the present invention can be used to store cereal and pre-packaged milk in the refrigerated section of a grocery store.

Figure 9:
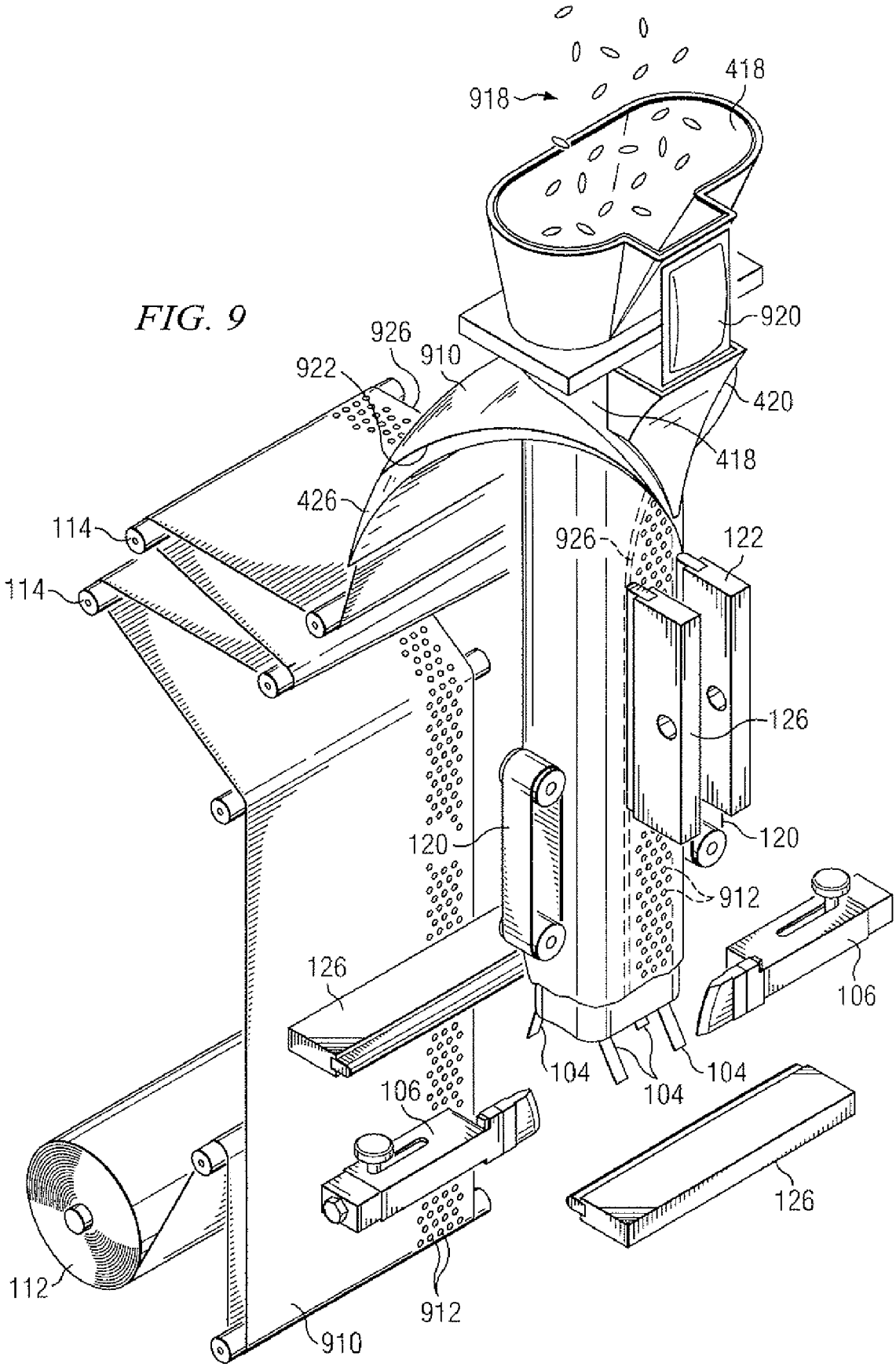
FIG. 9 is a perspective view of one embodiment of the present invention depicting a modified form, fill, and seal machine utilizing a permeable packaging film having a plurality of perforations disposed about a portion of the width and along the longitudinal axis of the film sheet.

FIG. 9 is a perspective view of one embodiment of the present invention depicting a modified form, fill, and seal machine utilizing a packaging film 910 having a permeable portion. In the embodiment shown, the permeable portion comprises a plurality of perforations 912, wherein the perforations 912 are disposed about a portion of the width and along the longitudinal axis of the film sheet 910. Of course, such embodiment is provided for purposes of illustration and not limitation. In one embodiment, the permeable portion can fracture open upon application of heat or physical stress. In one embodiment, the permeable portion is permeable to steam. A spiral former 426 receives the permeable packaging film 910 and directs the compartment terminal end (film inner end) 926 around a fill tube or first filling structure 418 to receive a first item 918. In one embodiment, the first item 918 comprises a microwavable food product. In one embodiment, the microwavable food product comprises half-product pellets. Half product pellets are known in the art and gradually expand upon microwave heating to form puffed pieces. Examples of such half-products are disclosed in U.S. Pat. Nos. 4,251,551 and 4,409,250.

Figure 10A:
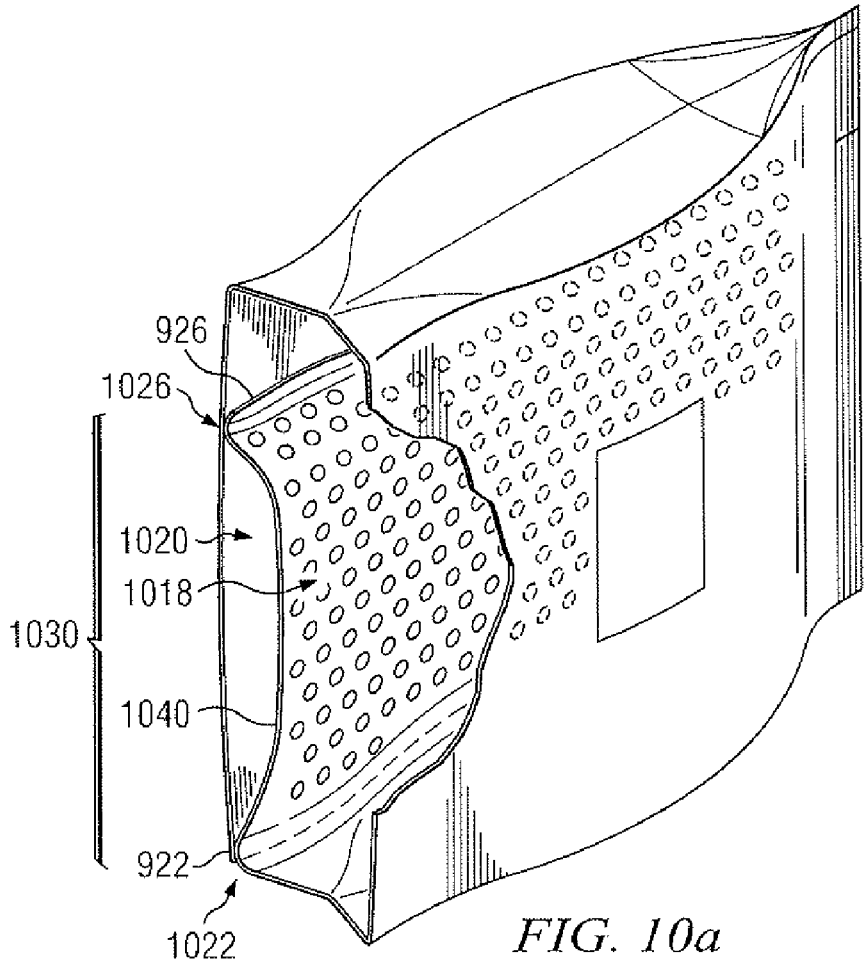
FIG. 10*a* is a cut-away perspective view of the package made from the assembly depicted in FIG. 9.
Figure 10B:
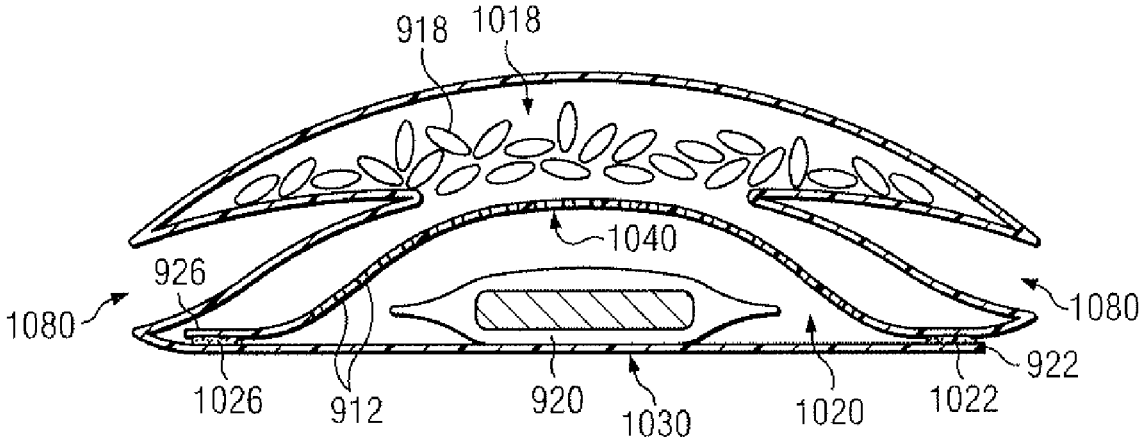
FIG. 10*b* depicts a cut away elevational view of a package made in accordance with one embodiment of the present invention.

The former 426 simultaneously directs the overlap end 922 to overlap the compartment terminal end 926. FIG. 10*a* is a cut-away perspective view of the package made from the assembly depicted in FIG. 9. Referring to FIG. 9 and F*igure* 10*a*, the spiral former 426 creates a first tube (that eventually results in a first compartment 1018 as shown in FIG. 10*a*) in communication with a first filling structure 418 and a second tube (that eventually results in a second compartment 1020 as shown in FIG. 10*b*) in communication with a second filling structure 420. The first and second tubes are separated by an inner permeable wall 1040, wherein the inner permeable wall 1040 has a compartment terminal end 926 that terminates inside the first tube. The second tube is defined by an overlapped segment of film 1030 and the inner permeable compartment wall 1040. The second filling structure 420 is adjacent the first filling structure 418 and situated so as to permit a second item 920 to be placed in the second compartment 1020. In one embodiment, the second item 920 comprises a steam pack assembly as disclosed in U.S. patent application Ser. No. 11/185,402 filed on Jul. 20, 2005, and assigned to the same assignee as the present invention.

As the film sheet 910 comprising two tubes is pulled downward by drive belts 120, the compartment terminal end 922 and overlap end 926 are sealed with vertical sealers 122 126 to seal the overlapped segment 1030 to the permeable compartment wall 1040. In one embodiment, the tubes then pass over oppositely positioned forming plates 104 and tucker bars 106 to provide gussets 1080 in the package. Although the embodiment depicted in FIG. 9 shows equipment for a double gusseted package, such example is shown for purposes of illustration and not limitation. The package in accordance with various embodiments of the present invention can have no gussets, or can have one or more gussets. Referring back to FIG. 9, upon completion of the longitudinal seals 1022 1026, the sealing jaws 126 can be used to make a first end seal. A first item 918 can then be placed into the first filling structure 418 in communication with the first tube and a second item 920 can be simultaneously placed through the second filling structure 420 in communication with the second tube. The film can be drawn downward by the drive belts 120 and a second transverse end seal can be used to make the first compartment 1018 and second compartment 1020. As shown in FIG. 10*a*, each compartment comprises an inner permeable compartment wall 1040 bounded by a first longitudinal seal 1022 and a second longitudinal seal 1026. In the embodiment shown, the package comprises two compartments 1018 1020 closed from one another.

In one embodiment, one or more of the longitudinal seals 1022 1026 comprises a cold seal. Cold seal technology is well known in the art and is widely used to close food packages having heat-sensitive foods such as chocolate bars where heat sealing of the package is not desirable. Cold seal adhesives are typically coated or printed onto a flexible packaging film to permit sealing of the package with pressure.

FIG. 10*b* depicts a cut away elevational view of a package made in accordance with one embodiment of the present invention. As shown in FIG. 10*b*, the first item 918 comprises an expandable food pellet in the first compartment 1018 and the second item 920 comprises a steam pack in the second compartment 1020. As shown two gussets 1080 can be provided to petit the first compartment 1018 to expand as the food product expands upon heating in a microwave. Even in the absence of food product expansion, the gussets 1080 can beneficially permit the first compartment 1018 to expand as steam generated by a steam pack in the second compartment 1020 through the perforations 912 in the inner permeable compartment wall 1040 and into the first compartment 1018.

The are several advantages provided by the present invention. First, the present invention provides a way to keep a food product separate from a steam or flavor emitting source. Direct contact with the steam or flavor emitting source and the food product is undesirable because moisture (liquid) rather than steam (gas) can contact the food product. Similarly, any condensation that contacts the food product is also undesirable. Moisture or condensation in contact with some food products can make certain food products soggy. Similarly, in some food products including half-products, condensation can lead to hard areas within the cooked product and facilitate pieces of food "welding" undesirably together into larger, congealed pieces. Further, condensation can prevent optimal expansion of a half-product. Advantageously, the present invention provides a package having a porous barrier between steam source and the food product such that the source itself does not contact the food product, yet the volatilized components from the source are in communication with the food product. The present invention can be achieved with relatively inexpensive modification of existing form, fill, and seal machinery to produce a package having an internal permeable wall between compartments. While the invention has been particularly shown and described with reference to a preferred embodiment, it will be understood by those skilled in the art that various changes in form and detail may be made therein without departing from the spirit and scope of the invention.

What is claimed is:

1. A method for making a microwavable package having a perforated wall between two compartments, said method comprising the steps of:

a) forming a sheet of film (910) into a first tube and a second tube wherein said first tube and said second tube are separated by an inner perforated compartment wall (1040) with a compartment wall terminal end (926) inside said first tube and wherein said second tube is defined by an overlapped segment of film (1030) and said inner perforated compartment wall (1040);

b) providing a first longitudinal seal (1022) and a second longitudinal seal (1026) to seal said overlapped segment (1030)3 to said inner perforated compartment wall (1040); and c) providing a first transverse end seal and a second transverse end seal to make a first compartment (1018) and a second compartment (1020).

2. The method of claim 1 further comprising the step of placing a food product into said first compartment (1018).

3. The method of claim 1 further comprising the step of placing a steam pack into said second compartment (1020).

4. The method of claim 1 further comprising the step of forming at least one gusset (1080) in said first tube (1018).

5. The method of claim 1 wherein said inner perforated compartment wall (1040) comprises a plurality of perforations (912).

6. The method of claim 1 wherein said inner perforated compartment wall (1040) fractures open upon application of heat or physical stress.

7. A method for making a microwavable package having at least two items, said method comprising the steps of:

a) overlapping a sheet of film having a plurality of perforations to form a first tube and a second tube separated by an inner perforated compartment wall (1040) having a terminal end (926);

b) sealing an overlap end (922) to said inner perforated compartment wall (1040) to form a first tube while sealing a compartment wall terminal end (926) to an overlapped segment of film (1030) to form a second tube;

c) providing a first transverse end seal by a pair of heat sealing jaws;

d) providing a first item through a first filling structure in communication with said first tube;

e) providing a second item through a second filling structure in communication with said second tube; and f) providing a second transverse end seal by a pair of heat sealing jaws to make a first compartment (1018) and a second compartment (1020).

8. The method of claim 7 wherein said first item comprises an expandable food product.

9. The method of claim 7 wherein said second item comprises a steam pack.

10. The method of claim 7 further comprising the step of providing at least one gusset in said first compartment.

11. The method of claim 7 wherein said inner perforated compartment wall (1040) fractures open upon application of heat or physical stress.

* * * * *